US012378886B2

(12) United States Patent
Richter et al.

(10) Patent No.: US 12,378,886 B2
(45) Date of Patent: Aug. 5, 2025

(54) HOLLOW ROD COMPOSITE ANCHOR WITH IMPROVED SETTING CAPABILITY AND METHOD FOR SETTING A HOLLOW ROD COMPOSITE ANCHOR INTO A ROCK STRATUM

(71) Applicant: JMBG GMBH + CO KG, Dortmund (DE)

(72) Inventors: Archibald Richter, Dortmund (DE); Friederich Jaeger, Dortmund (DE)

(73) Assignee: JMBG GMBH + CO KG, Dortmund (DE)

( * ) Notice: Subject to any disclaimer, the term of this patent is extended or adjusted under 35 U.S.C. 154(b) by 72 days.

(21) Appl. No.: 18/034,147

(22) PCT Filed: Dec. 20, 2021

(86) PCT No.: PCT/EP2021/086746

§ 371 (c)(1),
(2) Date: Apr. 27, 2023

(87) PCT Pub. No.: WO2022/136245

PCT Pub. Date: Jun. 30, 2022

(65) Prior Publication Data

US 2023/0383652 A1 Nov. 30, 2023

(30) Foreign Application Priority Data

Dec. 23, 2020 (DE) ..... 10 2020 134 856.8

(51) Int. Cl.
*E21D 21/00* (2006.01)
*E21D 20/02* (2006.01)

(52) U.S. Cl.
CPC ..... *E21D 21/0006* (2013.01); *E21D 20/026* (2013.01); *E21D 21/0026* (2013.01); *E21D 21/008* (2013.01)

(58) Field of Classification Search
CPC ..... E21D 21/0006; E21D 20/026; E21D 21/0026; E21D 21/008
See application file for complete search history.

(56) References Cited

FOREIGN PATENT DOCUMENTS

AU 8823756 A * 4/1989 ..... E21D 21/008
DE 69317784 T2 8/1998
(Continued)

OTHER PUBLICATIONS

International Search Report (English and German) and Written Opinion of the ISA (German) issued in PCT/EP2021/086746, mailed Mar. 16, 2022; ISA/EP.

*Primary Examiner* — Janine M Kreck
(74) *Attorney, Agent, or Firm* — Harness, Dickey & Pierce, P.L.C.

(57) ABSTRACT

The disclosure relates to a hollow rod composite anchor for stabilizing rock strata in mining, tunnel construction, underground construction, and rock construction, at least having an anchor base with one or more outlet channels, a hollow rod which is arranged behind the anchor base and contains a static mixing device and an adhesive cartridge with a press-out piston, said adhesive cartridge being arranged on the static mixing device via a cylindrical seal device with at least one bursting surface, wherein the outer diameter of the seal device substantially corresponds to the inner diameter of the hollow rod, the area of the bursting surface is greater than or equal to 15% and less than or equal to 90% of the cylinder cross-section of the seal device, and the ratio of the area of the bursting surface to the area of the hollow rod wall cross-section is greater than or equal to 0.1 and less than or equal to 25. The disclosure additionally relates to an improved method for setting hollow rod composite anchors.

14 Claims, 5 Drawing Sheets

(56) References Cited

FOREIGN PATENT DOCUMENTS

Figure 1:
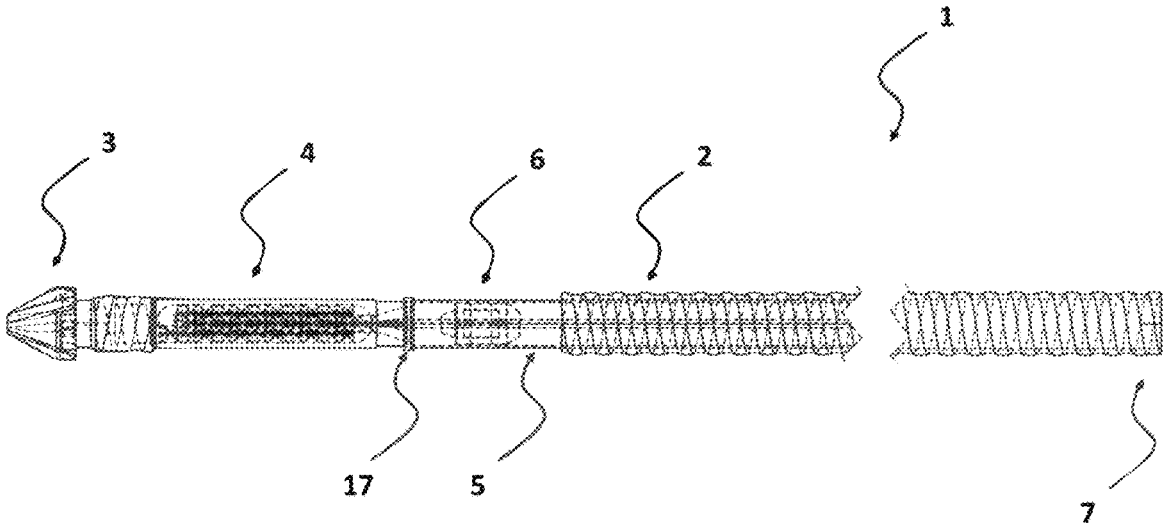

| | | | | | |
|---|---|---|---|---|---|
| DE | 102006006748 | A1 | | 7/2007 | |
| DE | 102006011652 | A1 | | 9/2007 | |
| DE | 102006046762 | A1 | | 4/2008 | |
| DE | 102010004926 | A1 | | 11/2010 | |
| DE | 102009056089 | A1 | | 6/2011 | |
| DE | 102010014612 | A1 | | 10/2011 | |
| GB | 2273538 | A | * | 6/1994 | ..... E21D 21/008 |

* cited by examiner

HOLLOW ROD COMPOSITE ANCHOR WITH IMPROVED SETTING CAPABILITY AND METHOD FOR SETTING A HOLLOW ROD COMPOSITE ANCHOR INTO A ROCK STRATUM

CROSS-REFERENCE TO RELATED APPLICATIONS

This application is a U.S. National Phase Application under 35 U.S.C. 371 of International Application No. PCT/EP2021/086746, filed on Dec. 20, 2021, which claims the benefit of German Patent Application No. 10 2020 134 856.8, filed on Dec. 23, 2020. The entire disclosure of the above German patent application is incorporated herein by reference.

FIELD

The disclosure relates to a hollow rod composite anchor for stabilizing rock strata in mining, tunnel construction, civil engineering and rock construction, at least comprising an anchor base with one or more outlet channels, a hollow rod arranged behind the anchor base and comprising a static mixing device and an adhesive cartridge with a squeezing plunger, wherein the adhesive cartridge is arranged via a cylindrical sealing device comprising at least one bursting surface at the static mixing device, wherein the outer diameter of the sealing device substantially corresponds to the inner diameter of the hollow rod and the bursting surface is greater than or equal to 15% and less than or equal to 90% of the cylindrical cross-section of the sealing device, wherein the ratio of the bursting surface to the area of the hollow rod wall cross-section is greater than or equal to 0.1 and less than or equal to 25. Furthermore, the present disclosure relates to an improved method for setting hollow rod composite anchors.

BACKGROUND

This section provides background information related to the present disclosure which is not necessarily prior art.

Nowadays, reproducible and permanent securing of unstable rock strata is still a challenging matter from technical and economic perspectives. Due to the increased securing requirements, for example in mining and tunnel construction, "reliable" approaches have so far been pursued as the gold standard, which, regardless of the concrete rock situation at hand, are based on significantly oversized but always sufficient "one-fits-all" solutions. In the field of stabilization of outer rock strata by mechanical anchors, this means in concrete terms that anchors are used which usually exceed the holding forces required for stabilization many times. The oversizing essentially concerns the design of the anchor dimensions and inevitably result in that anchor setting processes have to be "oversized" in terms of the performance of the machines used, the time required for this and the forces occurring during the setting process. The latter is not only costly, but also involves a non-negligible work safety risk, since the high forces that occur for fixing the anchors in the rock increase the risk of anchor malfunctions and/or uncontrollable behavior of the surrounding rock.

In the patent literature a wide variety of approaches with respect to the use and design of composite anchors can be found.

For example, DE 1020 060 467 62 A1 discloses a hollow rod composite anchor designed as a cartridge anchor, applicable as a two-step anchor for use in mining, tunnel construction, civil engineering and rock construction, comprising an adhesive at least partially embedded in a hollow rod bore of a hollow rod, in particular a prefabricated pressure-sensitive adhesive, at least one bursting valve provided at the anchor base side, and at least one piston positioned at the anchor base side, wherein the outer surface of the hollow rod composite anchor is coated with an adhesive, optionally with admixed filler.

As a further technical option, DE 1020 090 560 89 A1 discloses a single-phase self-drilling and two-phase cartridge spiral mixer anchor designed to be resistant to rotary impact, as a hollow rod anchor with/without drill bit, chip chamber, step mill and rotary slide, but with an externally applied or rolled-on mixer spiral, as an active motion mixer for thin-bed mixing with/without a fixed cartridge tube comprising the cooling channels and adhesive ribs for cooling the drill bit and for accommodating the adhesive cartridge with tensioning adhesive, designed for mixing the squeezed adhesive cartridge in the anchor ring chamber and for curing with a chemically controlled increase in volume, for additional anchor tensioning for use in mining, tunnel construction, civil engineering and rock construction, configured in such a way that with the externally applied mixer spiral as an active movement mixer, thin-bed mixing is carried out in the total anchor length.

A further embodiment of a device for fastening a rock anchor in a hole in the rock is disclosed in DE 69 317 784 T2, wherein said device comprises a fastening element, in particular an expansion anchor, provided on a threaded part at the inner end of a rock anchor, wherein the outer end of the rock anchor is provided with a washer-like pressure element adapted to press against the rock, comprising a nut on a threaded part at the outer end of the rock anchor for pressing against a support element having an opening for the supply of grout mortar for filling the cavity between the rock anchor and the rock, for improving the anchorage and for forming a corrosion protection, wherein the rock anchor is provided with a tube extending over at least the major part of the free length of the rock anchor and being adapted to supply grout mortar to the inner end of the rock hole, wherein the support element has the shape of an at least partially spherical shell with an inner space for supplying grout mortar through a hole formed in the side wall of said support element.

Such solutions known from the prior art can offer further potential for improvement, in particular with regard to a design of the device adapted to the rock situation at hand, wherein in particular the squeezing pressure and time are reduced and the simplicity and safety of the setting process are increased.

SUMMARY

This section provides a general summary of the disclosure, and is not a comprehensive disclosure of its full scope or all of its features.

It is thus an object of the present disclosure to at least partially overcome the disadvantages known from the prior art. In particular, it is the object of the present disclosure to provide an improved composite anchor and an improved method for setting a composite anchor in a rock layer, wherein in particular the setting process is made more reproducible, faster and safer.

The object is achieved by the features of the independent claims relating to the hollow rod composite anchor according to the invention as well as the method according to the invention. Preferred embodiments of the invention are provided in the subclaims, in the description or in the figures, wherein further features described or shown in the subclaims, in the description or in the figures may individually or in any combination constitute a subject matter of the invention, as long as the context does not clearly indicate the contrary.

According to the disclosure, the object is achieved by a hollow rod composite anchor for stabilizing rock strata in mining, tunnel construction, civil engineering and rock construction, at least comprising an anchor base with one or more outlet channels, a hollow rod arranged behind the anchor base containing a static mixing device and an adhesive cartridge with a squeezing plunger, wherein the adhesive cartridge is arranged at the static mixing device via a cylindrical sealing device comprising at least one bursting surface, wherein the outer diameter of the sealing device corresponds substantially to the inner diameter of the hollow rod and the bursting surface is greater than or equal to 15% and less than or equal to 90% of the cylindrical cross section of the sealing device, wherein the ratio of the bursting surface to the area of the hollow rod wall cross section is greater than or equal to 0.1 and less than or equal to 25.

Surprisingly, it has been found that by means of the hollow rod composite anchor structure according to the disclosure, rock strata can be secured quickly and reproducibly, wherein in particular the forces required for setting the anchor can be selected to be more adaptable and significantly lower compared to the solutions of the prior art. Due to the lower forces, the setting process can be accelerated and significantly improved in terms of work safety. Due to the structure according to the disclosure, the adhesive used can emerge very evenly via the anchor base into the rock strata and can fix the anchor very quickly with high retaining forces in the rock. The risk of mechanical failure of the anchor during setting is significantly reduced, and this design is particularly suitable for anchors with a large aspect ratio, since these require a high degree of adhesive volume. In this respect, even very deep boreholes can be filled reproducibly and safely by use of the structure according to the disclosure. Without being bound by theory, the advantages according to the disclosure result from the adaptation of the sealing device with a bursting disc, which can be used according to the disclosure, to the total volume and thickness of the hollow rod wall. In cases where the bursting area of the sealing device is too small, the flow resistance of the adhesive can lead to an increased pressure rise and to mechanical failure of the hollow rod. In these cases, significantly higher forces must be applied to squeeze out the adhesive. The latter can in particular increase the demands on the machines used to squeeze out the adhesive. Higher ratios of bursting area to wall area of the hollow rod cross-section can in particular account for that the mechanical strength of the bond is significantly above the required forces, which is associated with increased material costs. Furthermore, in higher ratios the usable adhesive volume is unnecessarily restricted, which can lead to only insufficient anchoring of the anchor in the rock due to the then lacking adhesive mass. In the preferred range of the ratio, an appropriately adapted amount of adhesive is provided with sufficient strength of the hollow rod composite anchor, wherein in particular the setting process can be accelerated and this can also take place all in all at lower pressures. This can reduce the mechanical load on the machinery and also increase work safety. The sealing device to be used according to the disclosure can also improve the shelf life of the hollow rod composite anchor, since the sealing device can efficiently prevent unintentional leakage of the adhesive material, for example due to mechanical stress during storage or transport.

The hollow rod composite anchor according to the disclosure is suitable for stabilizing rock strata in mining, tunnel construction, civil engineering and rock construction. Rock strata can be strengthened at the surface by inserting anchors to prevent rock fragments or slabs from slipping off unintentionally. The composite anchors are inserted into anchor holes, which can be produced either by a wet or dry drilling processes, depending on the hardness of the rock. The composite anchor comprises several assemblies, wherein in addition to the anchor base the other parts are usually arranged within a cylindrical hollow rod. The hollow rod may be made of metal, such as steel. The hollow rod composite anchor is first inserted at the anchor base side into the borehole and then pushed fully into the borehole by means of the hollow rod attached thereto. Here, it is possible that the hollow rod composite anchor is formed from only a single hollow rod with anchor base or from several hollow rods and an anchor base. The other hollow rods can serve as an extension of the first composite hollow rod anchor by means of a mechanical connection option.

The hollow rod composite anchor comprises at least one anchor base with one or more outlet channels. The anchor base is located at the deepest end of the borehole after insertion of the hollow rod composite anchor, and fastening agents can be fed out of the anchor base into the surrounding rock via the outlet channels. By means of the exiting fastening agents the entire anchor or at least a large part thereof is applied with adhesive on the outside, so that, after setting, a firm bond is formed between the hollow rod composite anchor and the surrounding rock stratum. The outlet channels can be arranged symmetrically or asymmetrically at or in the anchor base, and preferably the anchor base can comprise more than 2, more preferably more than 3 and further preferably more than 4 outlet channels.

A hollow rod is arranged behind the anchor base. The hollow rod with the other structural components of the hollow rod composite anchor can either be permanently connected to the anchor base or designed to be connectable thereto. For example, the hollow rod can be connected to the anchor base by means of a screwed, clamped, welded or bonded connection, or it can be connected to the anchor base shortly before insertion. In this way, variable anchor bases can be used for fastening, depending on the rock situation, or different hollow rods can be used, for example varying in hollow rod volume. The material of the hollow rod can preferably be made of metal, more preferably steel. Possible dimensions of the hollow rod are in a range of about 50 cm to 3 m in length and 2.5 cm to 50 cm in diameter.

The hollow rod comprises a static mixing device. Starting from the deepest end of the borehole first the anchor base extends and attachable thereto the hollow rod, wherein the static mixing device is located inside the hollow rod adjacent to the anchor base. A static mixing device comprises no mechanically driven mixing elements. The mixing action of the static mixer is essentially based on the forced guidance of the components to be mixed by the guiding devices of the static mixer. The components to be mixed are thus first guided through the static mixer, mixed therein and leave the mixing device in the direction of the anchor base. The mixed adhesive is passed through the outlet channels of the anchor base into the gap between the hollow rod composite anchor and the rock, where it then cures completely. Preferably, the mixing device can have an extension in the longitudinal direction of the hollow rod bond anchor of greater than or equal to 5 cm and less than or equal to 50 cm. Preferably, the ratio of mixer length to the total length of the hollow rod composite anchor, expressed as the length of the static mixer unit divided by the length of the hollow rod composite anchor, can be greater than or equal to 0.01 and less than or equal to 0.5. Within this range, good mixing results can be obtained while still maintaining sufficient adhesive volumes.

Furthermore, the hollow rod composite anchor comprises an adhesive cartridge with a squeezing plunger. The static mixer is filled with fastening agents via a cartridge, wherein the fastening agents can preferably be a one- or two-component adhesive. In the case of a two-component adhesive, the two components may be referred to as the hardener and the binder. The adhesive component or components disposed in the cartridge are partially liquefied via pressurization of the squeezing plunger and driven toward the mixer. There, the components are intimately mixed and react or emerge as such. The mixed adhesive leaves the anchor base through the outlet channels and cures between the outside of the anchor and the borehole wall, partially or completely over the length of the borehole up to the anchor base.

The adhesive cartridge is arranged at the static mixing device via a cylindrical sealing device comprising at least one bursting surface. The cylindrical sealing device can be arranged either directly in front of or spaced from the static mixing device. Preferably, however, no other functional devices of the hollow rod composite anchor are located between the cylindrical sealing device and the static mixing device. In the case in which the cylindrical sealing device is arranged spaced apart from the static mixing device, the distance can be established in a defined manner between the two devices, for example, by means of spacers, which are annular, for example. The cylindrical sealing device has a substantially cylindrical geometry, wherein the outer boundary to the hollow rod can be circular, for example. The cylinder can have a diameter of 10 to 40 mm, for example, while the extension along the hollow rod axis can be from 5 to 15 mm, for example. In this case, the sealing device has at least one surface which is adapted to open when pressurized and thus allow the adhesive to flow into the static mixer. The force required to open the bursting surface can, for example, be greater than 2 bar, further preferably greater than 5 bar and even more preferably greater than 7.5 bar. Within these force ranges, the sealing device can also protect the hollow rod composite anchor from unintentional leakage of the adhesive material during transport and storage and open it safely under application conditions.

The outer diameter of the sealing device corresponds substantially to the inner diameter of the hollow rod. The cylindrically shaped sealing device can have an outer diameter that essentially corresponds to the inner diameter of the hollow rod. Preferably, the sealing device can be insertable into the hollow rod by means of slight mechanical pressure. In these cases, the outer diameter of the sealing device substantially corresponds to the inner diameter of the hollow rod. Smaller diameters, for example outer diameters of the sealing device, which deviate from the inner diameter of the hollow rod by more than 3 mm, and further preferably by more than 2 mm, are not preferred, since these prevent a reproducible insertion of the sealing device into the hollow rod. In principle, the bursting surface can be of different design and have different valve types. For example, it is possible for the bursting surface to be in the form of a sealing surface that is partially released from the sealing device when pressurized. However, it is also possible that the bursting surface is formed by a plurality of overlapping sail surfaces that release from each other as a function of pressure and allow adhesive to flow through the sealing device.

The bursting surface is greater than or equal to 15% and less than or equal to 90% of the cylinder cross-section of the sealing device. The sealing device may be constructed of one or more retaining elements to which the actual bursting surface of the sealing device is attached. Due to the fact that the outer diameter of the cylindrical sealing device essentially corresponds to the inner diameter of the hollow rod, the total area of the sealing device can be calculated based on the circular area of the sealing device with half the outer diameter as the radius. The bursting surface within the sealing device is the area that allows adhesive to pass through under compressive stress. The bursting area in relation to the total area of the sealing device is in the range given above. Smaller ratios are not preferred, because these can contribute to an increased flow resistance of the adhesive during the squeezing process. Higher ratios are further not preferred, because they may affect the mechanical stability of the sealing device.

The ratio of the bursting surface to the area of the hollow rod wall cross-section, expressed as bursting surface divided by the wall area of the hollow rod cross section, is greater than or equal to 0.1 and less than or equal to 25. The area of the hollow rod wall cross section is obtained as the area of a circular ring comprising the outer and inner diameters of the hollow rod. Greater outer diameters and smaller inner diameters result in a large area of the hollow rod wall cross-section, wherein larger inner diameters and smaller outer diameters contribute to a decrease in the circular ring area. The above-mentioned ratio of bursting area to the area of the hollow rod cross-section establishes a preferred relation between the necessary squeezing pressure and the mechanical strength of the hollow rod, which leads in avoiding oversizing of the hollow rod composite anchor and achieving an improved squeezing process. Due to the relation, the mechanical forces can be absorbed in a defined way during the squeezing process by the hollow rod composite anchor, resulting in a very fast and reproducible squeezing process. In addition, by means of the adapted bursting surface the squeezing can be carried out very quickly and at very low pressures compared with prior art. In particular, this ratio allows to handle very difficult anchoring situations, which occur, for example, for particularly long anchors or require a high amount of adhesive material. Smaller ratios can be disadvantageous because these ratios reduce the possible use of adhesive material volume. Larger ratios may be disadvantageous because in this case the mechanical strength of the hollow rod may be too low. Further, the above mentioned ratio may preferably be greater than or equal to 0.25 and less than or equal to 9, further preferably greater than or equal to 0.5 and less than or equal to 8. These ratios may in particular contribute to an improved setting process from anchor lengths greater than or equal to 2 m, further preferably greater than or equal to 3 m, further preferably greater than or equal to 4 m.

In a preferred embodiment of the hollow rod composite anchor, the cylindrical sealing device may comprise two separate bursting surfaces. In principle, the cylindrical sealing device may comprise one or more bursting surfaces. However, in order to equalize the flow profile, it has been found to be particularly suitable that the sealing device according to the disclosure comprises two bursting surfaces that are decoupled from one another. The bursting surfaces are decoupled from each other in cases where the bursting surfaces do not allow the adhesive to pass through the bursting surfaces in common, but the adhesive can enter the static mixer via two different paths from the adhesive cartridge. The two bursting surfaces can be constructed, for example, such that the sealing device comprises a web that extends across the sealing device. In this embodiment, the separation by the web forms two separate bursting surfaces which extend from the web to respective opposite sides of the sealing device. This embodiment can be used in particular advantageously if the adhesive cartridge includes two different adhesives, for example in the form of a 2K composite adhesive.

In a further preferred embodiment of the hollow rod composite anchor, the cylindrical sealing device can be configured symmetrical and the two bursting surfaces can be arranged separately at the sealing device via a web extending along the diameter of the cylindrical sealing device. In order to even out the flow profile and to create a homogeneous mechanical load on the hollow rod composite anchor, it has proved particularly advantageous for the sealing device to comprise two bursting surfaces of approximately the same size, which are separated from each other by a web. In this way, the web may, for example, be arranged in the center of the cylindrical sealing device and extend over the entire diameter to the edges of the cylindrical sealing device. In this case, two bursting surfaces of equal size are formed, which extend from the web to the inner diameter of the cylindrical sealing device. In the case of further installation in the sealing device, for example by separation by means of a web, this web area is of course not added to the bursting area. Preferably, the bursting areas can be of equal size. For example, by using different volumes of a 2-component adhesive, an asymmetric design of the sealing device with respect to the areas of the two bursting surfaces may also be useful.

In a further preferred aspect of the hollow rod composite anchor, the bursting surfaces may be configured as bursting sails and the ratio of the holding force of the bursting sails at the web to the holding force of the bursting sails at the outer periphery of the sealing device, expressed as the holding force at the web divided by the holding force at the outer periphery, may be greater than or equal to 1.5 and less than or equal to 5. In order to ensure a sufficient shelf life of the hollow rod composite anchor and an opening of the bursting surfaces in a reproducible and uniform manner, it has been found to be particularly suitable for the mechanical holding force of the bursting surfaces at the sealing device to be configured asymmetrical. This essentially means that the mechanical forces for opening the bursting surfaces of the sealing device are non-uniform. Thus, the holding force of the bursting surfaces at the web is significantly greater than the holding force of the bursting surfaces at the outer circumference of the sealing device. Under sufficient mechanical load, this results in the bursting surfaces being released from the outer circumference of the sealing device first, wherein the mechanical connection to the web is maintained even under compressive load. In the case of two bursting surfaces, an opening of the bursting surfaces would occur from the outer circumference of the sealing device towards the web. In this embodiment, a uniform and controlled opening of the bursting surfaces can be achieved. The different holding forces of the bursting surfaces, once at the web and at the outer circumference of the sealing device, can be achieved, for example, by the use of different adhesives with different adhesive forces or by a different mechanical arrangement of the bursting surfaces at various points of the sealing device. The ratio can be measured, for example, by means of a mechanical compression test, wherein the force, which leads to a punctual failure of the holding force, is determined at different points of the bursting surface. For example, a measurement can be made directly at the outer circumference of the sealing device in the area of the bursting surfaces and the other measurement at the bursting surfaces directly at the web. Due to the relative specification of the forces, further specifications for carrying out the force measurement are unnecessary, since the concrete measurement conditions are determined on the basis of the comparative measurement.

Within a further preferred characteristic of the hollow rod composite anchor, the bursting surfaces in the area of the outer circumference of the sealing device can be connected to the sealing device via holding points. For a reliable protection of the hollow rod composite anchor during storage and for an opening process as uniform as possible with corresponding pressurization by the adhesive, it has proven particularly favorable that the different holding forces of the bursting surfaces are enabled via a different-sized fastening surface of the bursting surface. To this end, for example, the bursting surface in the area of the web can be completely connected to the web. In the area of the outer circumference, the bursting surface can be connected to the outer circumference of the sealing device at only a few points, so that the mechanical holding forces at the outer circumference are lower than the holding forces in the area of the web. When pressure is applied, the bursting surface in the area of the outer circumference of the sealing device is more likely to burst as a result of the lower holding forces and the bursting surface is only held in the area of the web. As a result, the bursting surface can fold towards the static mixer and release a small amount of adhesive. Preferably, the bursting surface in the area of the outer circumference of the sealing device can be established by holding points whose density is preferably at least 50%, further preferably at least 60% smaller than the density in the area of the web.

Within a preferred embodiment of the hollow rod composite anchor, the total bursting surface of the sealing device may be greater than or equal to 50% and less than or equal to 90% of the cylinder cross-section. In order to carry out a most suitable squeezing process, it has proven to be particularly advantageous that the entire bursting area in relation to the area of the sealing device, i.e. in relation to the cylinder cross-section or, stated differently, in realtion to the inner diameter of the hollow rod composite anchor, lies within the range specified above. This ratio allows a particularly fast squeezing process and ensures that the pressures required to squeeze out the adhesive cartridge are in the lower range. The squeezing process can be carried out with low demands on the devices for pressurization and, overall, work safety during the squeezing process can be increased by applying lowest possible mechanical forces. The above ratio may further preferably be greater than or equal to 55% and less than or equal to 75%, further preferably greater than or equal to 60% and less than or equal to 70%.

In a preferred aspect of the hollow rod composite anchor, the ratio of bursting surface to area of hollow rod wall cross-section may be greater than or equal to 0.4 and less than or equal to 3. This range of area ratios has been found to be particularly suitable for providing the fastest possible squeezing process. The mechanical safety of the entire hollow rod is ensured within this range and, in addition, the squeezing out of the adhesive can be ensured in a very short time interval by applying only low pressures. All in all, a mechanically stable and safe anchoring solution is provided, which is also cost-effective and increases the work safety of the user.

Within a further preferred embodiment of the hollow rod, the material of the hollow rod can have a breaking load in a tensile test according to DIN EN ISO 6892-16:2009-12 of greater than or equal to 80 kN and less than or equal to 800 kN. Furthermore, the material may have a modulus of elasticity measured according to ISO 10406-1:2008 in a tensile test of greater than or equal to 30 kN/mm$^2$ and less than or equal to 300 kN/mm$^2$. These mechanical characteristics of the hollow rod material can provide both the necessary flexibility and the necessary strength in order to safely handle the forces even for large bursting surface diameters at high squeezing rates. Values below the range of breaking of breaking load indicated above can be disadvantageous, since small bursting surface diameters can lead to high mechanical stresses in the area of the sealing device, which increases the risk of mechanical failure of the anchor. The same applies to the modulus of elasticity, which within the specified range can equally contribute to a safe setting of the anchor even under unfavorable bursting surface conditions. In particular, materials may be suitable which in sum have a modulus of elasticity and a breaking load within the specified ranges. Suitable materials include, for example, special fiber-reinforced composites, for example made of glass-fiber-reinforced polyester resin, or specially quenched steels. Preferably these materials can have an elongation at maximum force of greater than or equal to 0% and less than or equal to 25%, further preferably greater than or equal to 1% and less than or equal to 15%, and further preferably greater than or equal to 1.5% and less than or equal to 10%. These elongation ranges, especially when combined with the modulus of elasticity range and the specified breaking load, can contribute to particularly mechanically suitable anchors. In a further preferred embodiment of the hollow rod composite anchor, the hollow rod may, for example, be made of E355 steel. For providing a hollow rod composite anchor system as flexible as possible, the use of E355 steel (1.0580) has proven to be particularly suitable. The composition of the additional components of this steel type can be, for example, C≤0.22, Si≤0.55, Mn≤1.60, P≤0.03 and S 0.035%. In particular, this steel can have a particularly favorable effect on the ratio of bursting area to the area of the hollow rod composite anchor outer wall and contribute to applications in which the hollow rod composite anchor can be operated with a particularly low squeezing pressure. The use of this material also makes it possible to provide very long composite anchors with a high aspect ratio, which allow the anchor to be anchored particularly deeply in the rock. In particular, the structure according to the disclosure can also provide large quantities of adhesive material, which allow anchor lengths of greater than or equal to 3 m, furthermore of greater than or equal to 4 m and further preferably of greater than or equal to 6 m. These large anchor lengths can also be anchored very homogeneously in rock strata with low squeezing pressures. Without being bound by theory, the latter also results in particular from the fact that a large quantity of adhesive can be provided, which can be applied quickly and in low pressure ranges. This configuration also results in adhesive reserves, so that defects in the rock can also be advantageously compensated, i.e. filled with adhesive.

According to a further preferred embodiment of the hollow rod composite anchor, the width of the web may be greater than or equal to 1% and less than or equal to 15% with respect to the diameter of the cylindrical sealing device. In particular, a two-part division of the cylindrical sealing device with two bursting surfaces via a central web has proved to be particularly suitable. For the mechanical application of the adhesive, it has proved particularly favorable for the web to have the ratio indicated above. In the longitudinal direction, the web has essentially a length in the range of the inner diameter of the hollow rod composite anchor. In this range, the web width ensures that the web provides a sufficient mechanical strength and a suitable flow resistance. Larger widths can be disadvantageous, since in this case the squeezing pressure for dispensing the adhesive is unnecessarily increased by the anchor base. Smaller widths, on the other hand, can be disadvantageous because in these cases the mechanical strengths of the web are inadequate and the web can break when the adhesive is squeezed out. Within a further preferred embodiment, the width of the web may be greater than or equal to 5% and less than or equal to 10% with respect to the diameter of the cylindrical sealing device.

Within a preferred embodiment of the hollow rod composite anchor, the static mixing device may be greater than or equal to 20% and less than or equal to 70% with respect to the diameter of the cylindrical sealing device and spaced apart from the cylindrical sealing device. In order to ensure the most uniform and unimpeded opening of the bursting surfaces a spacing of the sealing device from the static mixing device has proven to be particularly suitable. The bursting surfaces can open unhindered and ensure an unimpeded passage of the adhesive. The spacing also reduces the risk that the bursting surfaces block the inlet(s) of the static mixing device. A squeezing process as smooth as possible can be ensured, and the pressures required for squeezing can also be reduced. A larger spacing can be disadvantageous, since in this case the dead volume of the hollow rod composite anchor is increased. The spacing can be ensured, for example, by means of spacer bars or spacer rings arranged at the static mixing unit. Further preferably, the ratio may also be greater than or equal to 40% and less than or equal to 55% with respect to the diameter.

Within a further preferred aspect of the hollow rod composite anchor, the contact area of the adhesive cartridge on the cylindrical sealing device may be greater than or equal to 20% and less than or equal to 55% of the cross-sectional area of the cylindrical sealing device. In order to ensure a homogeneous discharge process of the adhesive, the adhesive cartridge may be arranged directly at the cylindrical sealing device during the discharge process. For example, the adhesive cartridge can also have a cylindrical design for this purpose, wherein in the case of a two-component adhesive, the cylinder can be divided into two different compartments. The cylindrical configuration can, for example, be in the form of a cylindrical tube whose outer diameter corresponds approximately to the inner diameter of the hollow rod composite anchor. This cylinder may, for example, be in the form of a plastic tube, wherein the end face of the tube abuts the cylindrical sealing device. The contact surface is thus defined as the surface where the adhesive cartridge is in direct mechanical contact with the cylindrical sealing device. In this embodiment, therefore, the adhesive cartridge does not contact the cylindrical sealing device over the entire cross-sectional area of the sealing device. This can be accomplished, for example, by providing the sealing device or the adhesive cartridge with recesses rather than planar. In the recesses, the sealing device and the adhesive cartridge do not contact each other with or without load application. Lower proportions of contact surface can be disadvantageous, since in these cases sufficient mechanical fixation of the sealing device during the squeezing process cannot always be guaranteed. Higher ratios can also be disadvantageous, since in these cases stronger vibrations during storage can cause parts of the sealing device to yield prematurely unintentionally.

According to a further preferred characteristic of the hollow rod composite anchor, the adhesive cartridge can be divided into two compartments by a partition wall and the squeezing plunger can be designed in two parts corresponding to the compartment division, wherein a cutting device is arranged between the two parts of the squeezing plunger. The design according to the disclosure has proved particularly useful in cases where the anchor is fixed in the rock by means of a two-component adhesive. In this case, the two adhesive components can preferably be filled into the different compartments of the cartridge and be separated from each other by the partition wall. The two compartments of the cartridge may comprise the same or different volumes. The division into two components with cutting device can in particular result in that the squeezing process can be carried out with low squeezing forces even in complicated bonding situations. The cutting device can destroy the center web during the squeezing of the adhesive and ensure easy squeezing via only low mechanical forces.

Further, according to the disclosure a method for setting a hollow rod composite anchor in a rock layer is provided, wherein the method comprises at least the steps of:

a) drilling a hole in a rock stratum to be stabilized;
b) setting a hollow rod composite anchor according to the disclosure; and
c) squeezing the chemical fastening agents from the two compartments through the static mixer and the anchor base by pressurization.

Surprisingly, it has been shown that by means of the process according to the disclosure, rock strata that are difficult to stabilize can be secured in a very reproducible manner. The work safety is increased and the use of the hollow rod anchors according to the disclosure allows an adaptable response to the rock conditions at hand. Moreover, in contrast to the prior art anchors, the setting process can be carried out very quickly. For example, the squeezing process can take place within 15 seconds, preferably within 10 seconds and further below 5 seconds. Within these squeezing times very uniform stabilizations of the anchor in the rock can be achieved, which helps to reduce the costs of the setting process. Furthermore, it the squeezing process can be carried out advantageously by means of compressed air or water, wherein it is possible to work within very low pressure ranges. It is therefore advantageous that no special equipment is required for setting. For the further advantages of the process according to the disclosure, explicit reference is made to the advantages of the hollow rod composite anchor according to the disclosure.

In a preferred embodiment of the process, in process step c) the compressive load can be recorded over time for each squeezing operation and stored digitally. The recording and storage of the time-dependent pressure profiles of the squeezing process has proven to be particularly reliable for quality control of the setting process and for the detection of unpredictable rock anomalies. Unexpected positive or negative changes in the applied squeezing pressure can indicate deviations in the assumed properties of the existing rock formation, which can have a significant influence on the desired success of the stabilization measures. These can be detected via the pressure profile and give rise to further preventive measures.

In a further preferred embodiment of the method, the area ratio of the diameter of the hole drilled in method step a) to the hollow rod composite anchor inner diameter, calculated as hole diameter divided by hollow rod composite anchor inner diameter, can be greater than or equal to 1.5 and less than or equal to 2.5, preferably greater than or equal to 1.8 and less than or equal to 2.5. By use of the design of the hollow rod composite anchor according to the disclosure, it can be ensured that sufficient adhesive material can always be provided for the required anchoring situations. Due to the optimized size ratios of the anchor, it has turned out to be particularly favorable that the above-mentioned ratio between the circumference of the hollow rod composite anchor and the drilled hole is maintained. Within this range, very fast squeezing processes can be realized, which can also be carried out very reproducibly at particularly low pressure ranges. All in all, this can improve the quality of the anchoring and, in particular, work safety during the setting process.

DRAWINGS

The drawings described herein are for illustrative purposes only of selected embodiments and not all possible implementations, and are not intended to limit the scope of the present disclosure.

Further advantages and advantageous embodiments of the subject matter according to the disclosure are illustrated in the drawings and explained in the following description. It should be noted that the drawings are descriptive only and are not intended to limit the disclosure in any way.

Figure 2:
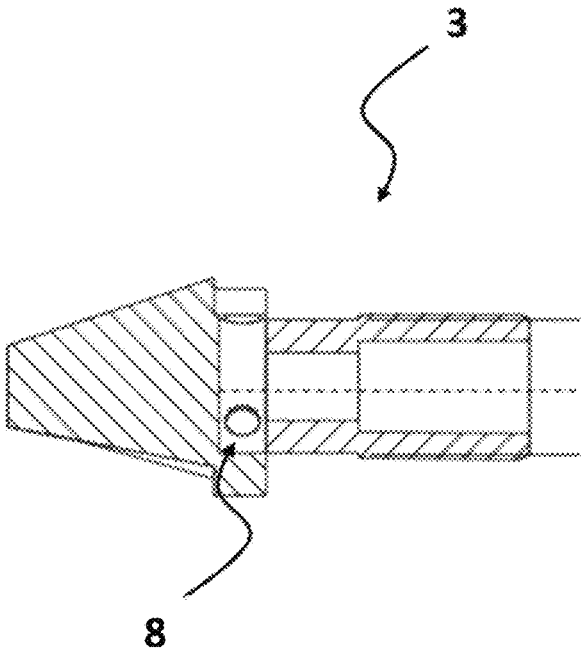
Figure 3:
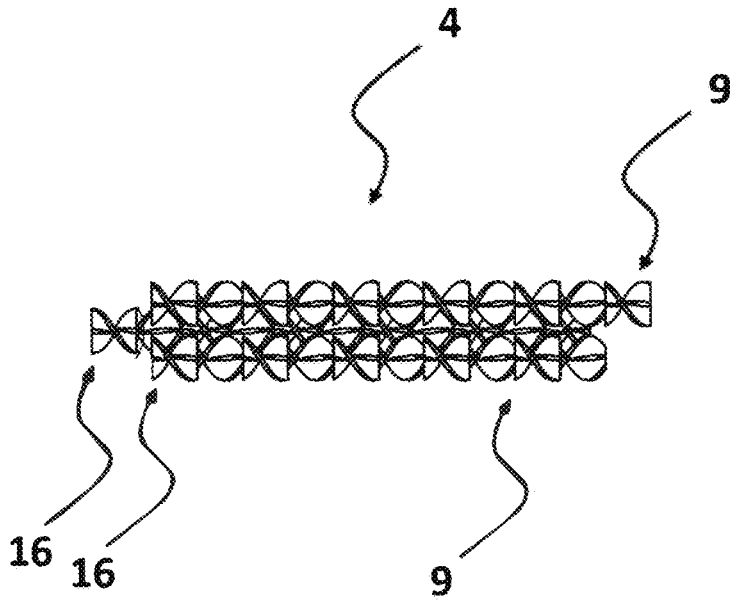
Figure 4:
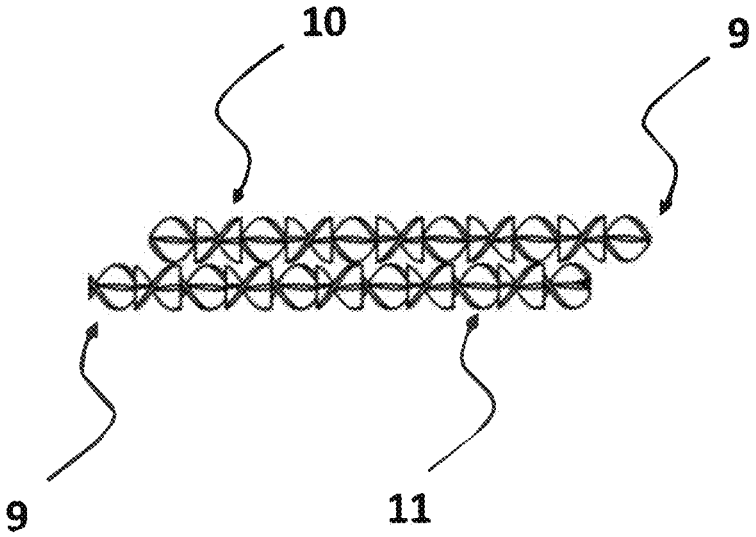
Figure 5:
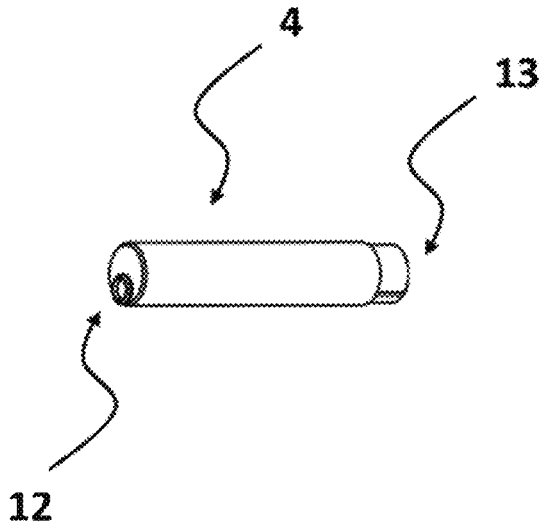
Figure 6:
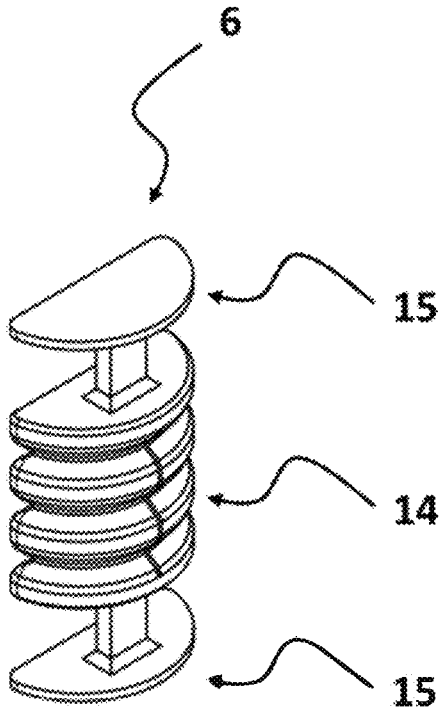
Figure 7:
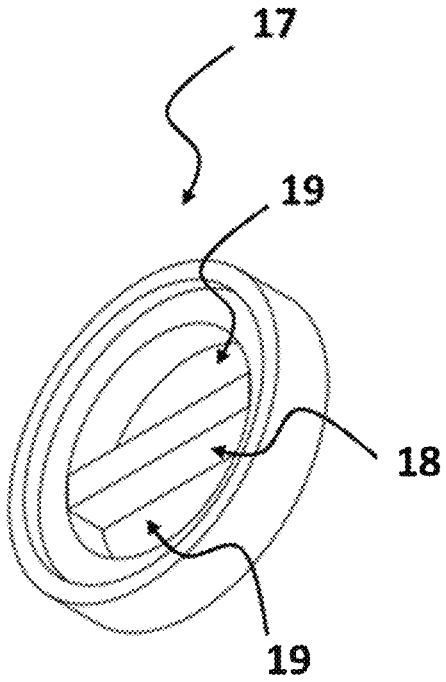
Figure 8:
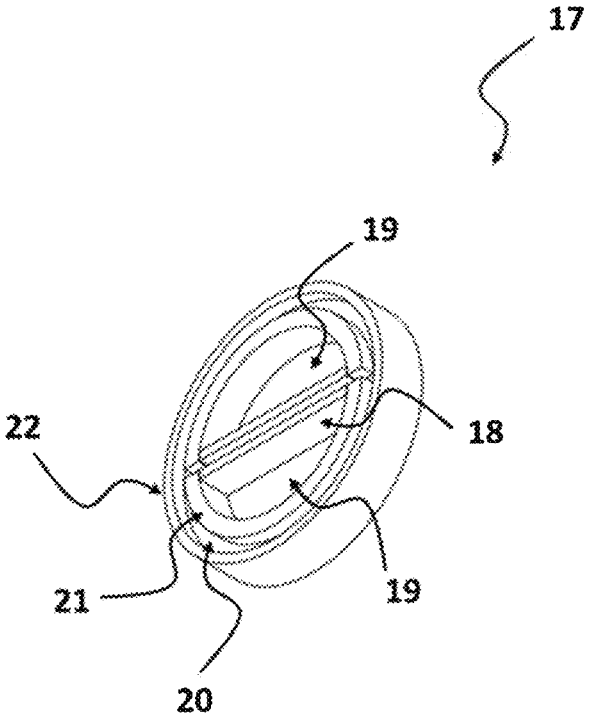
Figure 9:
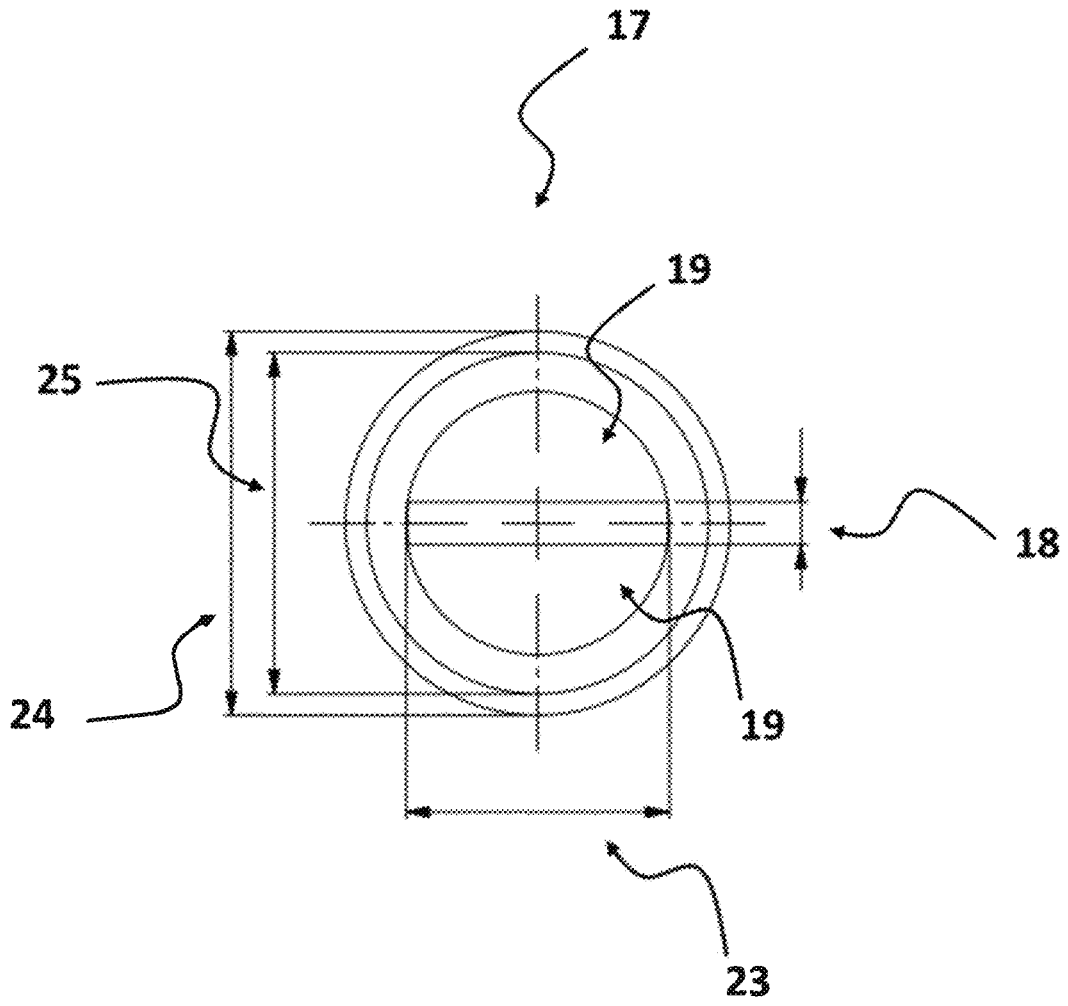

In the figures:

FIG. 1 schematically shows the structure of a hollow rod composite anchor according to the disclosure;

FIG. 2 schematically shows the structure of an anchor base with one or more outlet channels which can be used in the hollow rod composite anchor according to the disclosure;

FIG. 3 schematically shows a static mixing device that can be used in the hollow rod composite anchor according to the disclosure and consists of several mixing elements arranged one behind the other in a three-part mixing row combination;

FIG. 4 schematically shows a static mixing device which can be used in the hollow rod composite anchor according to the disclosure and consists of several mixing elements arranged one behind the other in a two-mixing row combination;

FIG. 5 shows a possible design of the mixing device which can be used in the hollow rod composite anchor according to the disclosure;

FIG. 6 schematically shows the structure of a squeezing plunger usable in the hollow rod composite anchor according to the disclosure;

FIG. 7 schematically shows the structure of a cylindrical sealing device usable in the hollow rod composite anchor according to the disclosure in an oblique view from below;

FIG. 8 schematically shows the structure of a cylindrical sealing device usable in the hollow rod composite anchor according to the disclosure in an oblique view from above; and FIG. 9 schematically shows a top view of the structure of a cylindrical sealing device usable in the hollow rod composite anchor according to the disclosure.

Corresponding reference numerals indicate corresponding parts throughout the several views of the drawings.

DETAILED DESCRIPTION

Example embodiments will now be described more fully with reference to the accompanying drawings.

FIG. 1 shows a possible embodiment of a hollow rod composite anchor 1 according to the disclosure. Starting from the deepest end of the borehole, the hollow rod composite anchor 1 comprises an anchor base 3, which comprises one or more outlet channels (not shown) for the outlet of a fastening agent from the hollow rod composite anchor 1. Via the outlet channels of the anchor base 3, fastening agent is pressed between the hollow rod composite anchor 2 and the borehole, and the hollow rod composite anchor 1 is thus anchored in the borehole. At the anchor base 3 the hollow rod 2 is arranged, which extends over the further functional parts (4, 5, 6, 17) of the hollow rod composite anchor 1 located in the interior. Inside the hollow rod 2, adjacent to the anchor base 3, the static mixing device 4 is disposed, in which the fastening agent, for example a two-component adhesive, is mixed before exiting through the anchor base 3. The adhesive is contained in a cartridge 5 divided into two compartments by a partition wall, which cartridge is squeezed out by a squeezing plunger 6 via pressurization. Between cartridge 5 and static mixer 4 the cylindrical sealing device 17 is arranged, which controls the supply of fastening agent to the static mixer 4. For example, this sealing device can prevent unintentional inflow of fastening agent into the static mixer during transport. In the application, the hollow rod composite anchor 1 is inserted into the borehole and the extrusion plunger 6 is moved forward, for example via water pressure, in the hollow rod 2 from the far end of the borehole 7 through the cartridge 5 toward the anchor base 3. The forces exerted press the adhesive out of the cartridge 5 through the sealing device 17, while opening the bursting surfaces, and into the static mixing device 4. In the mixing device 4, the adhesive is intimately mixed and enters the borehole via the outlet channel(s) of the anchor base 3 and anchors the hollow rod composite anchor 1 in the borehole via the outer anchor walls.

FIG. 2 shows a possible design of an anchor base 3. The anchor base 3 can comprise an anchor tip in which one or more outlet channels 8 for the fastening means are arranged.

FIG. 3 shows a side view of an arrangement of successive mixing elements 16 of the static mixing device 4 according to the disclosure. In this embodiment, the individual mixing elements 16 are combined to form three mixing element rows 9, wherein the row centers form a triangle relative to the direction of the force flow. This means that the mixing element rows 9 with the respective mixing elements 16 connected in series are arranged offset to each other, wherein the two different geometries for the individual mixing elements 16 are shown in this illustration. The flow of the fastening agent around the mixing elements 16 and rows 9 results in that the flow direction of the fastening means is deflected twice by approximately 180° between entry and exit from the static mixer (4). From the point of view of the force effect, the individual mixing element rows 9 and thus also the mixing elements 16 can be arranged offset from one another, so that different starting points of the mixing element rows 9 are obtained in the direction of the force effect.

FIG. 4 shows a side view of an arrangement of mixing elements 16 of the static mixing device 4 disposed one behind the other according to the disclosure. In this configuration, the individual mixing elements 16 are combined to form two mixing element rows 9, and the rear mixing element row of FIG. 3 has been omitted for the sake of clarity. The individual mixing element rows 9 are each composed of two different mixing elements 10, 11. These two designs 9, 10 of mixing elements 16 can contribute to an optimized mixing result without a large increase in flow resistance. Relatively large quantities of highly viscous fastening agents can also be processed with good mixing performance and an output pressure that is not too high.

FIG. 5 shows a possible enclosure of the static mixing device 4 within the hollow rod (not shown). The mixing elements, which may optionally be arranged in mixing rows, can be easily and securely inserted into and anchored in the hollow rod 2 by means of this enclosure. The opening 12 of the mixing device points in the direction of the anchor base 3 and the rear side 13 of the mixing device 4 points in the direction of the cartridge 5 divided into two compartments (not shown).

FIG. 6 shows a possible embodiment according to the disclosure of one half of a two-part squeezing plunger 6 according to the disclosure. The second half, which is not shown, is mirror-symmetrical to the first half 6 and is fixed to the first half 6 by means of a cutting device which is arranged between the two halves 6. In this figure, the upper and lower guide lips 15 and the central sealing lips 14 of the two-part squeezing plunger 6 are shown. By means of this embodiment, even highly viscous fastening agents can be safely squeezed out by the static mixing device 4. In particular, the risk is reduced that fastening means presses past the squeezing plunger 6 in the direction of the mouth of the borehole and thus can no longer contribute to fix the anchor in the borehole. In particular, the guide lips 15 can contribute to a smoother movement of the squeezing plunger 6, preventing canting even at high squeezing pressures or during rapid setting processes.

FIG. 7 schematically shows an embodiment of a cylindrical sealing device 17 according to the disclosure from the underside. In this case, the term "underside" means that the cylindrical sealing device 17 faces with this side in the direction of the static mixing device 4. The overall cylindrical configuration of the sealing device 17 with a substantially round circumference can be seen. The figure shows the cylindrical design of the sealing device 17 with a round circumference, which substantially abuts the inner wall of the hollow rod 2. The sealing device comprises a central web 18 and two bursting surfaces 19 separated thereby. Only by means of the bursting surfaces 19 the fastening agent can pass from the cartridge 5 in the direction of the static mixing device 4. The center web 18 extends along the diameter of the cylindrical sealing device 17 and ensures that the cylindrical sealing device 17 comprises bursting surfaces 19 separated from one another.

FIG. 8 schematically shows an embodiment of the sealing device 17 according to the disclosure in a view from "above". The term "above" in this case means that the cylindrical sealing device 17 points with this side in the direction of the adhesive cartridge 5. In this view, the central web 18 and the two bursting surfaces 19 separated by it are also shown. In addition, the contact surface 20 of the adhesive cartridge can be seen in this view, which is held and guided by two annular guides 21, 22. The adhesive cartridge 5 is pressed into the contact surface 20 of the adhesive cartridge by pressurization during the anchor setting process and is held in this position by the annular guides 21, 22. When the adhesive cartridge 5 is squeezed out by the plunger 6, adhesive is forced out of the adhesive cartridge 5 through the two bursting surfaces 19 in the direction of the static mixing device 4. The mixed adhesive exits the static mixing device 4 through the outlet channels 8 of the anchor base 3. The adhesive is pressed in the direction of the borehole mouth and bonds the outer sides of the hollow rod composite anchor 1 to the surrounding rock.

FIG. 9 shows the design of a cylindrical sealing device according to the disclosure 17 in plan view. The two bursting surfaces 19 can be seen, which are configured symmetrically and separated from each other by a central web 18. The sealing device 17 comprises an outer diameter 24 which corresponds essentially to the inner diameter of the hollow rod 2. In this embodiment, the sealing device comprises an outer protrusion with an inner diameter 25 which stabilizes the sealing device against the hollow rod 2. The available bursting area can be determined on the basis of the circular diameter 23, from which circular area the area of the central web 18 must still be subtracted.

The foregoing description of the embodiments has been provided for purposes of illustration and description. It is not intended to be exhaustive or to limit the disclosure. Individual elements or features of a particular embodiment are generally not limited to that particular embodiment, but, where applicable, are inter-changeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. A hollow rod composite anchor for stabilizing rock strata in mining, tunnel construction, civil engineering and rock construction, at least comprising an anchor base comprising one or more outlet channels, a hollow rod arranged behind the anchor base and including a static mixing device and an adhesive cartridge comprising a squeezing plunger, wherein the adhesive cartridge is disposed via a cylindrical sealing device comprising at least one bursting surface at the static mixing device, wherein the outer diameter of the sealing device essentially corresponds to the inner diameter of the hollow rod and the bursting surface includes a bursting surface area greater than or equal to 15% and less than or equal to 90% of the cylindrical cross-section area of the sealing device, wherein the ratio of the bursting surface area to a hollow rod wall cross-section area, expressed as the bursting surface area divided by the hollow rod wall cross-section area, is greater than or equal to 0.1 and less than or equal to 25.

2. The hollow rod composite anchor according to claim 1, wherein the cylindrical sealing device comprises two bursting surfaces separated from each other.

3. The hollow rod composite anchor according to claim 2, wherein the cylindrical sealing device is configured symmetrically and the two bursting surfaces are arranged separately from one another at the sealing device via a web extending along the diameter of the cylindrical sealing device.

4. The hollow rod composite anchor according to claim 3, wherein the bursting surfaces in an area of an outer circumference of the sealing device are connected to the sealing device via holding points.

5. The hollow rod composite anchor according to claim 3, wherein the width of the web is greater than or equal to 1% and less than or equal to 15% with respect to the diameter of the cylindrical sealing device.

6. The hollow rod composite anchor according to claim 1, wherein the bursting surface area of the sealing device is greater than or equal to 50% and less than or equal to 90% of the cylindrical cross-section area of the sealing device.

7. The hollow rod composite anchor according to claim 1, wherein the ratio of the bursting surface area to the area of the hollow rod wall cross-section is greater than or equal to 0.4 and less than or equal to 3.

8. The hollow rod composite anchor according to claim 1, wherein the material of the hollow rod has a breaking load (tension) according to DIN EN ISO 6892-1B: 2009-12 of greater than or equal to 80 kN and less than or equal to 800 kN.

9. The hollow rod composite anchor according to claim 1, wherein the static mixing device is spaced apart from the cylindrical sealing device by greater than or equal to 20% and less than or equal to 70% with respect to the diameter of the cylindrical sealing device.

10. The hollow rod composite anchor according to claim 1, wherein the contact surface of the adhesive cartridge on the cylindrical sealing device is greater than or equal to 20% and less than or equal to 55% of the cross-sectional area of the cylindrical sealing device.

11. A method for setting a hollow rod composite anchor in a rock layer, wherein the method comprises at least the steps of:

a) drilling a hole in a rock stratum to be stabilized;

b) setting a hollow rod composite anchor according to claim 1; and c) squeezing the chemical fastening agents from the adhesive cartridge through the static mixer and the anchor base by pressurization.

12. The method according to claim 11, wherein in method step c) the pressure load over time per squeezing operation is recorded and digitally stored.

13. The method according to claim 11, wherein the area ratio of diameter of the hole drilled in method step a) to hollow rod composite anchor inner diameter, calculated as hole diameter divided by hollow rod composite anchor inner diameter, is greater than or equal to 1.5 and less than or equal to 2.5.

14. The method according to claim 11, wherein the area ratio of diameter of the hole drilled in method step a) to hollow rod composite anchor inner diameter, calculated as hole diameter divided by hollow rod composite anchor inner diameter, is greater than or equal to 1.8 and less than or equal to 2.5.

* * * * *